US006733352B1

(12) United States Patent
Belter et al.

(10) Patent No.: US 6,733,352 B1
(45) Date of Patent: May 11, 2004

(54) ELECTRONICALLY CONTROLLED COOLING SYSTEM FOR A MARINE PROPULSION ENGINE

(75) Inventors: David J. Belter, West Bend, WI (US); Steve Wynveen, Germantown, WI (US); Michael A. Karls, Hilbert, WI (US); Troy J. Kollmann, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/434,784

(22) Filed: May 9, 2003

(51) Int. Cl.[7] ..... B63H 21/10
(52) U.S. Cl. ..... 440/88 C; 440/1
(58) Field of Search ..... 440/88 C, 88 R, 440/1; 123/41.13, 41.05, 41.08

(56) References Cited

U.S. PATENT DOCUMENTS

| | | | | | |
|---|---|---|---|---|---|
| 3,918,418 | A | | 11/1975 | Horn | 123/41.08 |
| 4,457,727 | A | * | 7/1984 | Flaig | 440/88 R |
| 4,669,988 | A | | 6/1987 | Breckenfeld et al. | 440/88 |
| 5,330,376 | A | * | 7/1994 | Okumura | 440/88 R |
| 5,555,855 | A | | 9/1996 | Takahashi | 123/41.08 |
| 5,579,727 | A | | 12/1996 | Logan et al. | 123/41.14 |
| 5,642,691 | A | | 7/1997 | Schroeder | 123/41.09 |
| 5,664,526 | A | | 9/1997 | Logan et al. | 123/41.14 |
| 5,876,256 | A | * | 3/1999 | Takahashi et al. | 400/1 |
| 5,980,342 | A | | 11/1999 | Logan et al. | 440/88 |
| 6,331,127 | B1 | | 12/2001 | Suzuki | 440/88 |

* cited by examiner

*Primary Examiner*—S. Joseph Morano
*Assistant Examiner*—Lars A. Olson
(74) *Attorney, Agent, or Firm*—William D. Lanyi

(57) ABSTRACT

The temperature regulation system is provided which places a flow controlling valve at a location which can be different than the location of the temperature being controlled. In other words, a valve can be located at a remote position relative to, cooling passages of an engine block or head. Signals from temperature sensors are provided to a microprocessor of an engine control module and the engine control module controls the operation of the valve in response to the measured temperatures. The engine control module can select different temperature ranges as a function of selected operating conditions of the engine, such as engine speed. In addition, the engine control module can cycle the valve in order to free it of debris when it is sensed that the valve is not responding in an expected manner.

5 Claims, 3 Drawing Sheets

ELECTRONICALLY CONTROLLED COOLING SYSTEM FOR A MARINE PROPULSION ENGINE

BACKGROUND OF THE INVENTION

1. Field of the Invention

The present invention generally relates to an electronically controlled cooling system and, more particularly, to a cooling system which includes a valve that is controlled by a microprocessor as a function of one or more temperature measurements made in conjunction with the cooling system of an internal combustion engine.

2. Description of the Prior Art

Many different types of systems are known to those skilled in the art for controlling the temperature of an internal combustion engine.

U.S. Pat. No. 6,331,127, which issued to Suzuki on Dec. 18, 2001, describes a marine engine. An engine for a watercraft includes a cooling system having a coolant supply. The coolant supply supplies an engine coolant jacket with a flow of coolant that is controlled by a temperature dependent flow control valve. The coolant supply also supplies an exhaust conduit coolant jacket independently of the engine coolant jacket.

U.S. Pat. No. 5,642,691, which issued to Schroeder on Jul. 1, 1997, discloses a thermostat assembly for a marine engine with a bypass. The thermostat assembly is used with a marine engine having a closed loop cooling system and provides an additional bypass for engine coolant flow. The assembly includes a housing having an inlet that receives engine coolant, a thermostat outlet that is connected to a heat exchanger, and a bypass outlet that is connected directly to a circulating pump that circulates engine coolant to the engine and bypasses the heat exchanger. A thermostat having a restricting plate is mounted in the thermostat outlet in the housing. The housing includes an internal structural standoff around the bypass outlet. When engine coolant enters the thermostat housing and the thermostat is closed, engine coolant passes between the thermostat restricting plate and the bypass standoff and flows through the bypass outlet directly to the circulating pump.

U.S. Pat. No. 5,555,855, which issued to Takahashi on Sep. 17, 1996, describes a water circulation system for a marine engine. The system improves the consistency of engine combustion by stabilizing the temperature of water flowing through the engine water jacket and by heating the intake manifold to a temperature within a desired temperature range. The desired temperature range is defined so as to optimize fuel vaporization without significantly affecting the volumetric efficiency of the engine. The water circulation system includes a control valve which directs water flow through the circulation system according to the water temperature exiting the engine water jacket. The valve recirculates water between the engine water jacket and a recirculation path until the water temperature reaches a predetermined lower temperature limit. The control valve then allows a portion of the water to flow through a heating jacket around the intake manifold to heat the intake manifold. If the temperature of the recirculating water reaches a predetermined upper temperature limit, the control valve directs all of the water through the heating jacket until the temperature of the water exiting the engine water jacket falls below the upper temperature limit.

U.S. Pat. No. 4,669,988, which issued to Breckenfeld et al on Jun. 2, 1987, describes a marine engine cooling system valve assembly. A marine propulsion device comprising an internal combustion engine including a coolant conduit having an upstream conduit portion, a downstream conduit portion, and a passage portion extending between the upstream portion and the downstream portion is described. The engine also includes a mechanism for controlling the flow of coolant through the coolant conduit, the controlling mechanism including a valve assembly located in the passage portion and including therein an opening, a temperature responsive mechanism located in the valve assembly and movable relative to the opening for opening and closing the opening in response to temperature variations.

U.S. Pat. No. 3,918,418, which issued to Horn on Nov. 11, 1975, discloses a marine engine cooling system employing a thermostatic valve, means and a pressure relief valve means. A pressure relief valve for the engine of an outboard motor includes a valve plate connected to a stem and spring loaded water cooling passageway, in close spaced relation to a then thermostatically controlled valve passageway. The stem extends outwardly through a water discharge chamber directly in communication with the discharge passageway to the lower unit of the motor.

U.S. Pat. No. 5,664,526, which issued to Logan et al on Sep. 9, 1997, discloses an apparatus for separating solid material from cooling water in a marine engine block. An apparatus for separating solid material from cooling water in the cooling system of the engine block of a marine engine is described. The engine block comprises a plurality of cylinder bores surrounded by a cooling passage through which cooling water is pumped. The bottom portion of the block includes a drain outlet that communicates with the cooling passage and a tubular separating member has a first generally horizontal section that is sealed within the drain outlet. The tubular separator also includes a second section that is located within the cooling passage and extends downwardly from the inner end of the first section and is located between two adjacent cylinder bores.

U.S. Pat. No. 5,579,727, which issued to Logan et al on Dec. 3, 1996, discloses a separating apparatus for the cooling system of a marine engine. An apparatus for separating solid material from cooling water in the cooling system of a marine engine is disclosed. The apparatus includes a hollow member or housing having an inlet to receive cooling water and having an outlet. A drain opening is located in the housing above the bottom surface of the housing and is connected through a suitable conduit to a temperature responsive drain valve. A generally J-shaped tubular member is disposed in the housing and has one end connected to the drain outlet while a second end is slightly above the bottom surface of the housing, out of alignment with the inlet.

U.S. Pat. No. 5,980,342, which issued to Logan et al on Nov. 9, 1999, discloses a flushing system for a marine propulsion engine. The flushing system provides a pair of check valves that are used in combination with each other. One of the check valves is attached to a hose located between the circulating pump and the thermostat housing of the engine. The other check valve is attached to a hose through which fresh water is provided. Both check valves prevent flow of water through them unless they are associated together in locking attachment.

Internal combustion engines typically use conventional mechanical thermostats to regulate the flow through cooling passages of the engine. The conventional mechanical thermostat typically blocks the flow through certain cooling passages when the cooling water is below a desired temperature. This allows the water to increase in temperature through prolonged exposure to heat producing portions of the engine. When a desired temperature is reached, the conventional mechanical thermostat opens its valve to allow the water to flow through the cooling passage to remove heat from the engine. In a closed cooling system, the coolant is circulated through a heat exchanger which removes heat from it prior to redirecting the coolant back to the engine cooling passages. In an open cooling system, water is obtained from a body of water and directed through the cooling passages. After the water removes heat from the engine, it is returned to the body of water. Open cooling systems can be subject to blockage by debris that is in the body of water in which a marine vessel is operated. The debris is taken into the cooling system, typically by a water pump, and flows, through the cooling channels of the engine's cooling passages. The debris can block the cooling passages.

Conventional mechanical thermostats are commonly used to regulate the flow of coolant through cooling passages of an internal combustion engine. Because of their structure and theory of operation, conventional mechanical thermostats are typically designed to result in a preselected temperature of water flowing through the thermostat or in thermal communication with it. Regulation of the temperature of the cooling system to a desired temperature that is not identical to the temperature range of the conventional mechanical thermostat cannot be done with conventional thermostat system. In addition, opening or closing the conventional mechanical thermostat by a remote control means is also not typically possible.

It would be significantly beneficial if an engine cooling system could be provided that is controllable to different temperature ranges, as a function of operating conditions of the engine, and which can also be manipulated in such a way that debris can be removed from certain blocking positions within the cooling system.

The patents described above are hereby expressly incorporated by reference in the description of the present invention.

SUMMARY OF THE INVENTION

A temperature regulation system for an internal combustion engine, made in accordance with the preferred embodiment of the present invention, comprises a fluid passage disposed in thermal communication with a heat producing portion of the internal combustion engine, a valve connected in flow controlling relation with the fluid passage, a temperature sensor disposed in thermal communication with a preselected portion of the internal combustion engine, and a microprocessor connected in signal communication with the temperature sensor and with the valve.

The valve has a first state in which cooling water is permitted to flow through the fluid passage and a second state in which cooling water is prevented from flowing through the fluid passage. The microprocessor is configured to cause the valve to switch between the first and second states as a function of a signal received from the temperature sensor which is representative of a temperature at the preselected portion of the internal combustion engine. The valve is connected to the fluid passage at a location which is downstream from the engine and in a discharge passage of the fluid passage. The system can further comprise a pump connected in fluid communication between the fluid passage and a source of water, such as a body of water.

Although the present invention is described in terms of a valve having a first state and a second state which represent open and closed positions, respectively, it should be clearly understood that alternative valves can be used. These alternative valves can have many optional states between fully opened and fully closed. A ball valve, for example, can be moved to any one of a plurality of positions between fully opened and fully closed. Valves of either type can be used in conjunction with the present invention.

A method for controlling a cooling system of an internal combustion engine, in accordance with the preferred embodiment of the present invention, comprises the steps of providing a fluid passage disposed in thermal communication with a heat producing portion of the internal combustion engine, providing a valve connected in flow controlling relation with the fluid passage, providing a temperature sensor disposed in thermal communication with a preselected portion of the internal combustion engine, and providing a microprocessor connected in signal communication with the temperature sensor and with the valve.

The method can further comprise the steps of measuring a temperature of the preselected portion of the internal combustion engine, comparing the temperature of the preselected portion of the engine to a preselected desired temperature or temperature range, causing the valve to assume a first state when the temperature exceeds the desired temperature and causing the value to assume a second state when the temperature is less than the desired temperature. The first state is representative of a greater flow of fluid through the fluid passage than the second state.

The method of the present invention can further comprise measuring the temperature of the preselected portion of the internal combustion engine when the valve is expected to be in the second state and then causing the valve to assume the first state for a preselected period of time when the temperature is less then a predetermined expected temperature as a function of the valve being in the second state. This method further comprises the step of causing the valve to assume the second state subsequent to the step of causing the valve to assume the first state for a preselected period of time.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
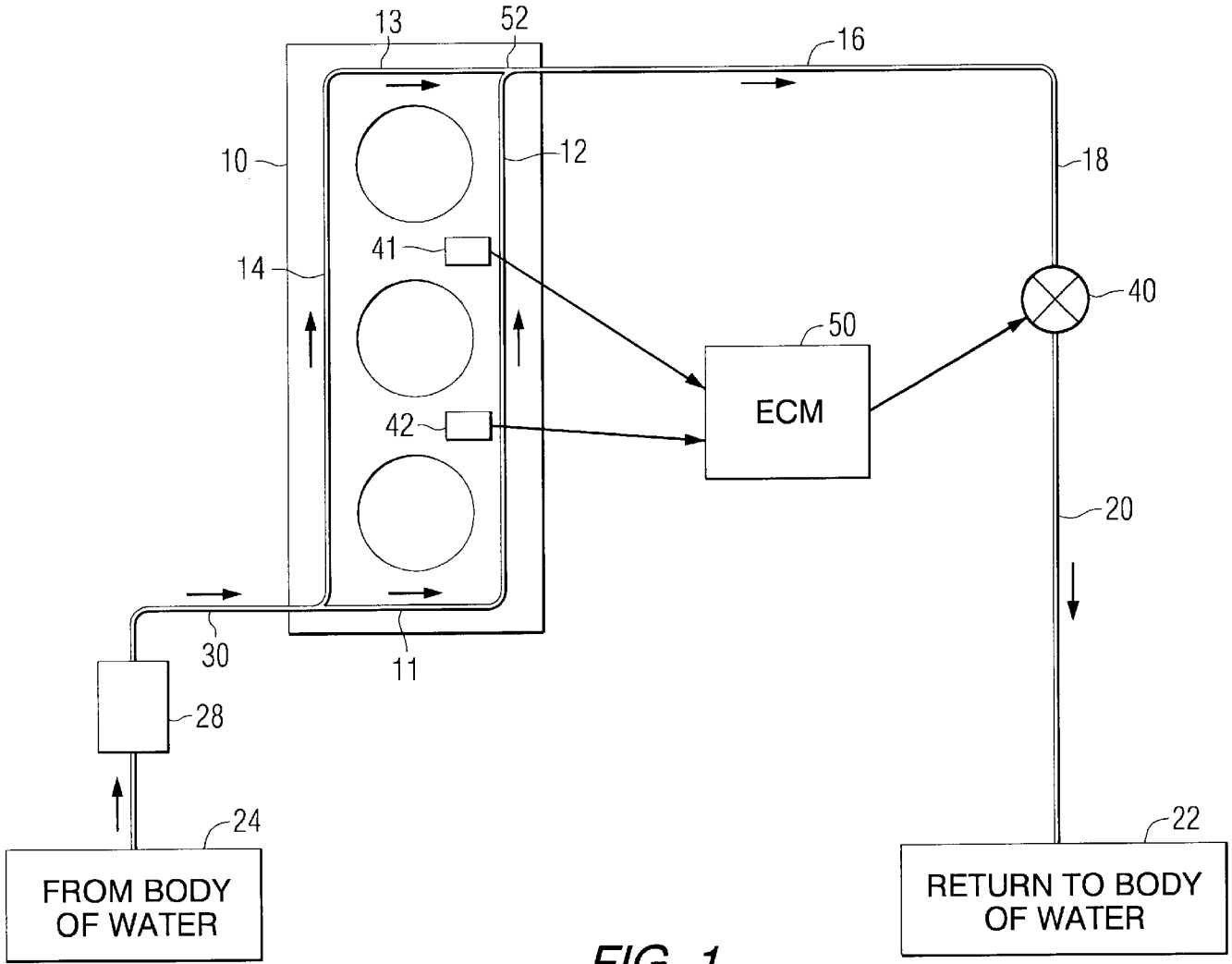
FIG. 1 is a schematic representation of a marine engine, temperature sensors, a valve, and a microprocessor of the present invention.

Throughout the description of the preferred embodiment of the present invention, like reference numerals will be used to identify like components.

FIG. 1 is a highly schematic representation of a cooling system of an internal combustion engine 10 for a marine propulsion system. The engine 10 is provided with a fluid passage that is disposed in thermal communication with a heat producing portion of the engine. In FIG. 1, arrows 11–14 represent passages formed in the block and head of the engine 10 to direct a cooling fluid, such as water, in thermal communication with heat producing regions of the engine. Those skilled in the art of internal combustion engine production are familiar with many types of cooling jackets and passages that are used to direct a flow of cooling fluid in thermal communication with these heat producing regions. The fluid passage of the present invention comprises the conduits identified by reference numerals 11–14 in addition to other conduits. After the water has passed through the internal combustion engine 10, it proceeds along conduits 16 and 18 toward a discharge conduit 20 which allows the cooling water to be discharged back into a body of water from which it was drawn, as represented by block 22 in FIG. 1.

The cooling water is initially drawn from a body of water, as represented by functional block 24 in FIG. 1, by a water pump 28 which causes the water to flow through conduit 30 into the fluid passage, 11–14, that is disposed in thermal communication with heat producing regions of the engine 10.

A valve 40 is connected in flow controlling relation with the fluid passage, between the discharge conduit 20 and the cooling conduits of the internal combustion engine 10. In FIG. 1, temperature sensors 41 and 42 are schematically represented as being disposed in thermal communication with a preselected portion of the internal combustion engine 10. Although a single temperature sensor, 41 or 42, can be used in conjunction with the present invention, it is anticipated that more than one temperature sensor can improve the operation of the engine 10. In addition, a plurality of temperature sensors, 41 and 42, provide a degree of redundancy in case one sensor fails.

The valve 40 has a first state in which cooling water is permitted to flow through the fluid passage, 11–14, conduits, 16 and 18, and the discharge conduit 20. It has a second state in which cooling water is prevented, or inhibited, from flowing through these fluid passages. The microprocessor of the engine control module 50 is configured to cause the valve 40 to switch between the first and second states as a function of signals received from the temperature sensors, 41 and 42, which are representative of a temperature at the preselected portion of the internal combustion engine. If the temperature indicated by the temperature sensors, 41 and 42, indicate that the temperature of the internal combustion engine 10 is less than a desired range, the engine control module 50 can close the valve 40 to prevent water from leaving the engine at the location identified by reference numeral 52. This is accomplished by placing the valve 40 in its second, or closed, state. This blocks water from flowing into the discharge conduit 20 and being ejected back to the body of water. Alternatively, if the measured temperature of the engine 10 is above a desired range, the valve 40 is opened by the engine control module 50 to allow water to flow out of the location identified by reference numeral 52 and proceed through the discharge conduit 20. This, of course, allows additional water to be pumped by water pump 28 from the body of water and into conduit 30. This introduces colder water into the cooling system of the engine 10 and reduces its temperature. By modulating the state of the valve 40, the engine control module 50 can easily maintain the temperature of the engine 10 within a desired range.

As described above, although the present invention is described in terms of a valve 40 having a first state and a second state which represent fully opened and fully closed positions, respectively, it should be clearly understood that alternative valves can be used in which they have many optional states between fully opened and fully closed. A ball valve, for example, can be moved to any one of a plurality of positions between fully opened and fully closed. Valves of either type can be used in conjunction with the present invention.

Unlike a conventional mechanical thermostat system, the engine control module 50 can change the desired temperature range during the operation of the engine 10. For example, a first range can be used when the engine is being operated at idle speeds and a second range can be used when the engine is operating at wide open throttle (WOT). In addition, other operating parameters of the engine can be monitored and the desired temperature range can be selected from a plurality of alternatives as a function of those monitored parameters. This type of switching of desired temperature ranges is not possible when a conventional mechanical thermostat is used because the thermostat is typically provided with a temperature sensitive material that cannot be changed during the operation of the engine.

With continued reference to FIG. 1, it is well known to those skilled in the art that some valves can become blocked by debris drawn by the water pump 28 from the body of water. This debris can possibly lodge in the valve 40 and inhibit its proper closure to achieve its second state of operation. When this happens, the present invention allows the engine control module 50 to sense this blockage and, in response, cycle the valve 40 to its first state for a preselected period of time and then cause it to assume its second state. Opening the valve 40 for the preselected period of time can allow the debris to be swept through the valve 40 and discharged back to the body of water through the discharge conduit 20. This feature would typically be used after it is recognized that something is blocking the valve 40. For example, if the engine control module 50 causes the valve 40 to assume its second state, in which it is closed, but the engine temperature measured by the temperature sensors, 41 and 42, do not indicate the expected rise in temperature, the engine control module 50 can be programmed to assume that debris is preventing the valve 40 from completely closing. In response to this recognition, the engine control module 50 can cause the valve 40 to open completely and assume its first state for a preselected period of time, usually a few seconds. Subsequently, the valve 40 is again closed as originally intended. The temperature of the engine 10 can again be monitored to see if this technique was successful in clearing the debris from the valve 40.

Figure 2:
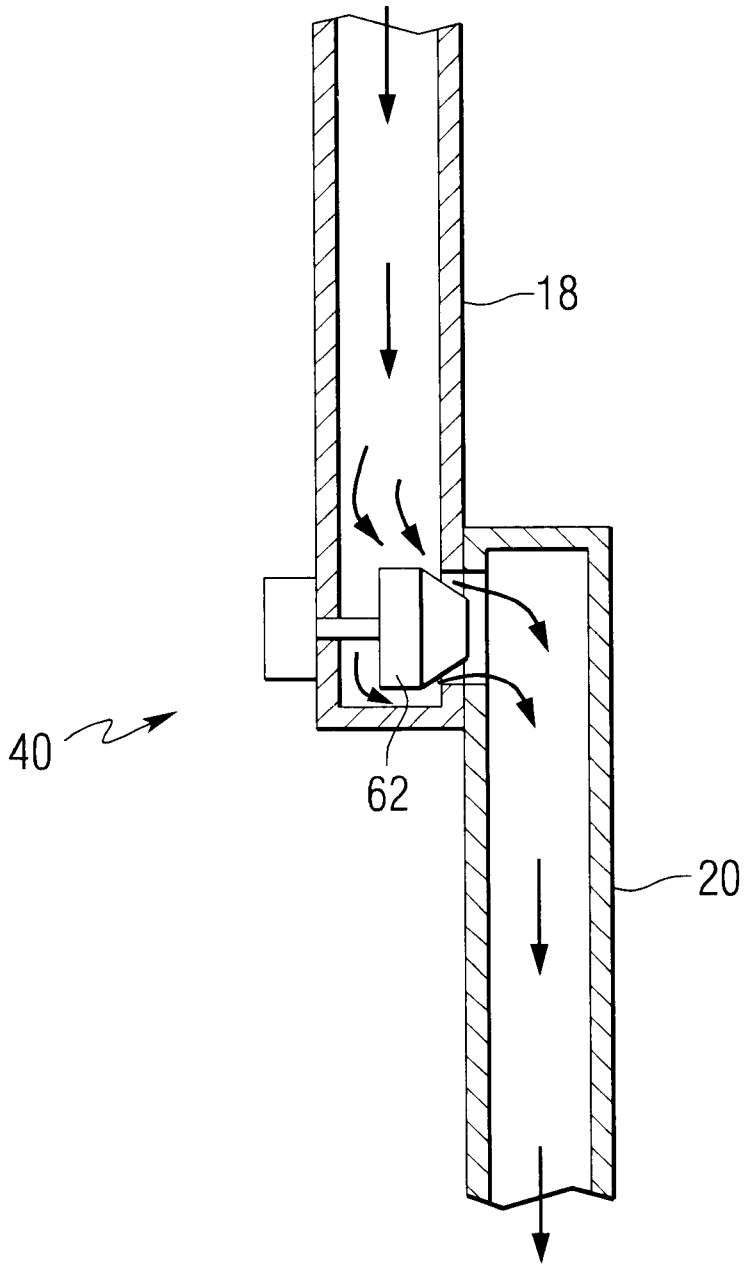
FIG. 2 is a section view of the valve portion of the present invention.

FIG. 2 is a simplified schematic representation of the valve 40 in conjunction with the discharge conduit 20 and the conduit 18 of the fluid passage described above. Water flows from the various conduits, 11–14, that remove heat from the engine 10 and then continues to flow through conduits 16 and 18 to the valve 40. This can be seen in FIG. 1.

In FIG. 2, the valve 40 is illustrated in a highly simplified manner to show its basic function. In FIG. 2, the valve 40 is shown in its first state which allows water to flow from conduit 18 to the discharge conduit 20, as represented by the arrows. The water flows into the discharge conduit 20 and back to the body of water from which it was drawn by the pump 28. When the plunger 62 is moved toward the right in FIG. 2, it blocks water from flowing into the discharge conduit 20. That closed position is the second state of the valve 40. It should be understood that when the valve 40 is in its second state, water flow through conduit 18 is stopped. This, in turn, stops water from flowing through conduits 11–14 in the engine 110. As a result, movement of the valve 40 into its second state tends to cause the temperature of the engine 10, as measured by temperature sensor 41 and 42, to rise.

Figure 3:
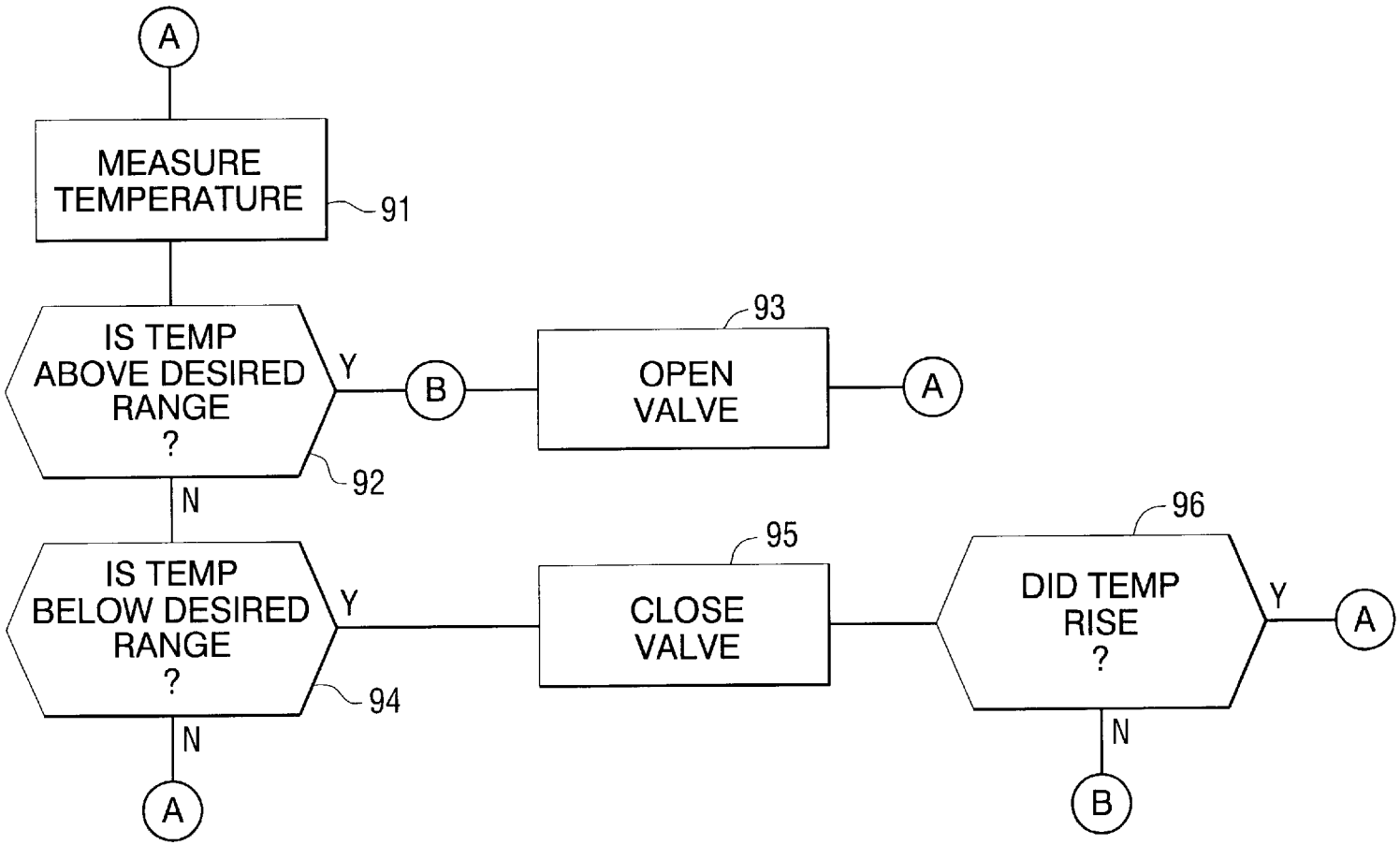
FIG. 3 is a flowchart of the method of the present invention.

FIG. 3 is a simplified flow chart of the method of the present invention. Two important functions can be performed by the present invention, as will be described below in conjunction with FIG. 3. Briefly stated, one function is to maintain the temperature of the engine within a desired temperature range. The second function is the ability to respond to the collection of debris that may be blocking or interfering with the correct operation of the valve 40.

In FIG. 3, the process begins with the measuring of the temperatures represented by the one or more temperature sensors, 41 and 42, described above. This is illustrated in functional block 91. If the temperature is above a desired range, as determined at functional block 92, the microprocessor opens valve 40 as represented by functional block 93. This allows water to flow through the valve 40 and through the discharge conduit 20 so that fresh water can be provided by the pump 28 to the cooling conduits, 11–14 to reduce the temperature of the engine. If on the other hand, the temperature is not above the desired range, the microprocessor of the engine control module 50 determines whether or not it is below the desired range. This is done at functional block 94. If the temperature is below the desired range, valve 40 is closed as represented by functional block 95. Closing valve 40 stops the water from flowing through the engine 10 and allows the temperature to rise because of the cessation of heat removal by the water flowing through the fluid passages.

With continued reference to FIG. 3, after the valve is closed at functional block 95, the present invention checks to see if the temperature of the engine 10, as measured by sensors 41 and 42, rises as indicated by functional block 96. This is an important element of the present invention. For example, if the attempted closure of the valve 40, indicated at functional block 95, does not successfully move the plunger 62 because of an obstruction resulting from a collection of debris, the system will not operate as expected. If debris is blocking the valve 40 from closing, water will continue to flow into the discharge conduit 20, as illustrated in FIG. 2. This will prevent the temperature of the engine 10 from rising to the desired range.

If the temperature rises as expected, functional block 96 is satisfied and the program returns to the initial node A. If the temperature does not rise in response to the valve being closed at functional block 95, it can be assumed that the valve 40 may be blocked. In this event, the program goes to step B to open the valve at functional block 93 and then returns to the beginning of the program. This opening of the valve 40, particularly after being closed at functional block 95, may dislodge any debris that might be preventing the plunger 62 from completely closing and preventing water flow into the discharge conduit 20. It is expected that the logic represented in FIG. 3 will again direct the program from functional block 94 to functional block 95 after this is completed. Again the temperature rise is monitored at functional block 96 to determine whether or not the debris had been cleared and the engine temperature is rising as expected.

Several differences between the present invention and the prior art provide significant advantages. Known cooling systems for engines which use conventional mechanical thermostats are limited in several important ways. First, a conventional mechanical thermostat has a fixed temperature range at which it operates. That temperature range cannot be changed during the operation of the engine to satisfy changing demands which are determined as a function of the operating characteristics of the engine. The present invention allows different ranges to be selected by the engine control module 50 as a function of various monitored parameters of the engine.

In addition, it should be noted that an important distinction between the prior art and the present invention is that the temperature sensing mechanism of the present invention is not part of or closely connected to the valve. In most applications of the present invention, the temperature sensing devices, such as sensors 41 and 42, are located either directly in the water stream of the coolant passages or attached to the metallic engine block or engine head, depending on the specific zone which is being monitored. Thermostats, on the other hand, place the temperature responsive element, such as a wax element, directly in the valve structure. This means that the temperature of the water must be monitored at the location of the valve when a conventional mechanical thermostat is used. The present invention, on the other hand, places the valve and the temperature sensors at different locations, as represented in FIG. 1. The engine control module 50 is provided with temperature signals electronically and controls the valve electronically. In certain embodiments of the present invention, the valve 40 can be solenoid driven, but it should be understood that any type of remotely controlled valve can be used in conjunction with the present invention.

Another important difference between the prior art and the present invention is that the present invention can clear the valve when it is determined the debris is preventing the valve from completely closing. Conventional mechanical thermostats are subject to blockage by debris when used in a marine engine and are not provided with any ability to allow the debris to be cleared by the flow of water through the thermostat.

Although the present invention has been described in particular detail and illustrated to show a preferred embodiment, it should be understood that alternative embodiments are also within its scope.

We claim:

1. A temperature regulation system for an internal combustion engine, comprising:

a fluid passage disposed in thermal communication with a heat producing portion of said internal combustion engine;

a valve connected in flow controlling relation with said fluid passage, said valve being connected to said fluid passage at a location which is downstream from said engine and in a discharge passage of said fluid passage;

a temperature sensor disposed in thermal communication with a preselected portion of said internal combustion engine; and a microprocessor connected in signal communication with said temperature sensor and with said valve, said valve having a first state and a second state, said second state decreasing the rate of flow of cooling water out of said engine relative to the rate of flow of said cooling water out of said engine when said valve is in said first state.

2. The system of claim 1, wherein:

said microprocessor is configured to cause said valve to switch between said first and second states as a function of a signal received from said temperature sensor which is representative of a temperature at said preselected portion of said internal combustion engine.

3. The system of claim 1, further comprising:

a pump connected in fluid communication between said fluid passage and a source of water.

4. The system of claim 3, wherein:

said source of water is a body of water.

5. The system of claim 4, wherein:

said valve is connected in fluid communication between said heat producing portion and said body of water.

* * * * *